US005462034A

United States Patent [19]

Kadota

[11] Patent Number: 5,462,034

[45] Date of Patent: Oct. 31, 1995

[54] INTENSIVE SELF-DIAGNOSING SYSTEM FOR ENGINE EXHAUST GAS CONTROL COMPONENTS AND SYSTEMS

[75] Inventor: Yoichi Kadota, Hyogo, Japan

[73] Assignee: Mitsubishi Denki Kabushiki Kaisha, Tokyo, Japan

[21] Appl. No.: 208,383

[22] Filed: Mar. 10, 1994

[30] Foreign Application Priority Data

Jul. 27, 1993 [JP] Japan ..... 5-204509

[51] Int. Cl.[6] ..... F02M 25/08

[52] U.S. Cl. ..... 123/520; 123/690

[58] Field of Search ..... 123/518, 519, 123/520, 198 D, 688, 690, 698

[56] References Cited

U.S. PATENT DOCUMENTS

| | | | |
|---|---|---|---|
| 5,070,847 | 12/1991 | Akiyama et al. | 123/690 |
| 5,085,195 | 2/1992 | Kuruda et al. | 123/520 |
| 5,085,197 | 2/1992 | Mader et al. | 123/520 |
| 5,143,035 | 9/1992 | Kayanuma | 123/198 D |
| 5,150,686 | 9/1992 | Okawa et al. | 123/520 |
| 5,150,689 | 9/1992 | Yano et al. | 123/519 |
| 5,195,498 | 3/1993 | Siebler et al. | 123/698 |
| 5,213,088 | 5/1993 | Harada | 123/690 |
| 5,220,896 | 6/1993 | Blumenstock et al. | 123/520 |
| 5,224,462 | 7/1993 | Orzel | 123/698 |
| 5,275,144 | 1/1994 | Gross | 123/520 |
| 5,331,560 | 7/1994 | Tamura | 123/690 |

FOREIGN PATENT DOCUMENTS

| | | |
|---|---|---|
| 2130255 | 5/1990 | Japan . |
| 4143452 | 5/1992 | Japan . |
| 4237861 | 8/1992 | Japan . |

*Primary Examiner*—Thomas N. Moulis

*Attorney, Agent, or Firm*—Sughrue, Mion, Zinn, Macpeak & Seas; Richard C. Turner; Joseph J. Buczynski

[57] ABSTRACT

Malfunction of a purge air control system is checked based on a variation of a fuel tank inner pressure or an air-fuel ratio in response to forced introduction of purge air into an engine. During a mode of checking malfunction of the purge air control system, failure/malfunction checks on other exhaust gas control components/systems, such an ignition system, an $O_2$ sensor and a fuel supply system, are prohibited.

4 Claims, 6 Drawing Sheets

INTENSIVE SELF-DIAGNOSING SYSTEM FOR ENGINE EXHAUST GAS CONTROL COMPONENTS AND SYSTEMS

BACKGROUND OF THE INVENTION

The present invention relates to a system of self-diagnosing exhaust gas control components/systems for an automobile engine. More specifically, the invention relates to a control procedure (logic) of a self-diagnosing function portion which has a function of checking a failure/malfunction of those components/systems in an intensive manner.

As the issue of earth environments becomes more significant, stricter regulations are now being enforced on exhaust gas produced from automobiles. With this trend, it is now necessary to provide a function of monitoring and checking whether components and systems relating to the exhaust gas control are working normally. Among those components and systems are a purge air control system for controlling transpired gas (hereinafter referred to as "purge air") from a fuel tank, an ignition failure detection system for monitoring whether the combustion of an engine is normal, and an 02 feedback control system for properly effecting the cleaning by a catalyzer.

For example, Japanese Patent Application Unexamined Publication No. Hei. 2-130255 discloses a conventional diagnosing device that is provided for an automobile engine to check its purge air control system. This diagnosing device checks malfunction of the purge air control system independently of failure/malfunction checks on other exhaust gas control components/systems, such as an ignition system (ignition failure), an $O_2$ sensor and a fuel supply system.

FIG. 1 shows the entire system relating to the conventional purge air control. Reference numeral 1 denotes a fuel tank; 2, a pressure sensor for detecting pressure in the fuel tank 1; and 3, a canister having activated carbon for absorbing purge air coming from the fuel tank 1. A solenoid A serves to open/close an air passageway 4 for passing purge air to the atmosphere. A solenoid B serves to open/close an engine-side passageway 5, which is connected to an engine intake pipe 20. Reference numeral 6 denotes an automobile engine; 7, an engine control computer unit (ECU) for controlling the engine 6; 8, injectors for supplying fuel to the engine 6; 9, an $O_2$ sensor attached to an engine exhaust pipe 21; 10, a crank shaft sensor for measuring a crank shaft angle; 11, a water temperature sensor; 12, a fuel pressure regulator; and 13, a fuel pump.

With reference to FIG. 6, a description will be made of a conventional operation of checking for malfunctions of the purge air control system. Purge air accumulated in the space of the fuel tank 1 is absorbed by activated carbon provided in the canister 3. The air passageway 4 of the canister 3 is usually opened to the atmosphere, and serves as an emergency passageway to discharge purge air from the canister 3 only when an abnormally large amount of purge air is absorbed in the canister 3.

The ECU 7 monitors information sent from sensors attached to respective parts of the engine 6. If the ECU 7 judges that the engine operation state is such that the canister 3 is capable of absorbing purge air, it establishes a purge check mode (at time $T_0$) and turns off the solenoids A and B to close the air passageway 4 of the canister 3 and the engine-side passageway 5, to thereby seal the purge air passageway. With no places for escape, the space of the fuel tank 1 is filled with purge air to increase the pressure in the fuel tank 1. When this state has continued for a predetermined period (until time $T_1$; the tank internal pressure increases up to $P_0$), the solenoid B is turned on to discharge the purge air filling the canister 3 to the engine intake pipe 20 for a predetermined period (until time $T_2$). As a result, the fuel tank internal pressure decreases to $P_1$.

Then, the solenoid B is turned off to again close the purge air passageway, and a period ($t_m$) necessary for the tank internal pressure to make a predetermined increase ($\Delta P_2$) is measured.

If the purge air control system is operating normally, the tank internal pressure changes in a manner as indicated by a solid line in FIG. 6, in which case the period $t_m$ is measured as $t_2$. On the other hand, if there exists a leak of purge air due to, for instance, damage of the solenoid A or B or the purge air passageway anywhere between the fuel tank 1 and the engine intake pipe 20, the tank internal pressure changes in a manner as indicated by a broken line in FIG. 6, in which case the period $t_m$ is measured as $t_1$. That is, the pressure increases more slowly.

In the above manner, malfunction of the purge air control system can be checked based on the length of the pressure increase period $t_m$.

Next, a conventional operation of checking an ignition failure will be described with reference to FIG. 7

The ECU 7 detects the rotation speed of the engine 6 by measuring the period of a signal sent from the crank shaft sensor 10. When an ignition failure occurs in the engine 6 at time $T_{100}$ in FIG. 7, no torque is generated by a cylinder of the ignition failure. Therefore, the rotation speed of the crank shaft decreases to elongate the period of the signal sent from the crank shaft sensor 10. That is, the period increases to $T_{B1}$ at time $T_{200}$. It is judged that an ignition failure has occurred when $T_{B1}$ exceeds an ignition failure judgment level $T_{B2}$. Thus, a failure in ignition components can be detected.

Next, with reference to FIG. 8, a description will be made of a conventional operation of checking a failure of the $O_2$ sensor 9.

The top part of FIG. 8 shows the onset of an $O_2$ sensor failure check mode, the middle part shows a waveform of an output signal of the $O_2$ sensor 9, and the bottom part shows a control signal sent from the ECU 7 to the injector 8 and indicating the amount of fuel to be supplied to the engine 6.

In FIG. 8, the usual $O_2$ feedback control is performed until time $T_{20}$. That is, if the output signal of the $O_2$ sensor indicates a rich state (the air-fuel ratio A/F is smaller than 14.7), the amount of fuel supplied to the engine 6 is decreased. Conversely, if the output signal of the $O_2$ sensor indicates a lean state (A/F is larger than 14.7), the amount of fuel is increased. Thus, the fuel supply amount is adjusted to reverse the output signal of the $O_2$ sensor 9.

When the ECU 7 judges (at time $T_{20}$ ) that the engine 6 is in such a state that the $O_2$ sensor failure check mode should be established, the ECU 7 produces an instruction to keep the fuel supply amount at a predetermined lower level ($F_1$) for a predetermined period (time $T_{20}$ to $T_{21}$), and an instruction to thereafter keep it at a predetermined higher level ($F_2$) for another predetermined period (time $T_{21}$ to $T_{22}$).

If the $O_2$ sensor 9 is normal, its output signal is decreased to a level $V_{L1}$ at time $T_{21}$(the end of the lean period), and thereafter increased in response to the increase of the fuel supply amount to reach a predetermined judgment level $V_{th}$ after a lapse of a period $t_{h1}$. On the other hand, if the $O_2$ sensor 9 is deteriorated, common results are such that the response output voltage has a lower value or a delay. Therefore, when a deteriorated $O_2$ sensor 9 is mounted on the engine 6, there may occur such a case that the sensor output voltage decreases only to a level $V_{L2}$ at time $T_{21}$or it takes a longer period $t_{h2}$ to reach the judgment level $V_{th}$. The deterioration of the $O_2$ sensor 9 can be detected based on those values.

Next, with reference to FIG. 9, a description will be made of a conventional operation of checking malfunction of the fuel supply system.

In a system in which the $O_2$ feedback control is performed, the output voltage of the $O_2$ sensor is larger than 0.5 V when the air-fuel ratio (A/F) is smaller than 14.7 (rich state), and is smaller than 0.5 V when A/F is larger than 14.7 (lean state). In general, to maintain the air-fuel ratio of 14.7, which is most appropriate in terms of the exhaust gas performance, the amount of fuel supplied to the engine 6 is controlled so as to reverse the output voltage of the $O_2$ sensor, as was described above in connection with FIG. 8.

In the system under consideration, an $O_2$ feedback correction coefficient is used so as to realize an integration type correction in which the fuel supply amount is changed gradually with respect to time elements as shown in FIG. 9. If respective components of the fuel supply system are normal (until time $T_{40}$ in FIG. 9), usually the $O_2$ feedback correction coefficient varies in the vicinity of 1.0. However, if there exists in the fuel supply system a deteriorated component (e.g., an injector 8) whose characteristics are different than the normal one, the above-described $O_2$ feedback control is effected to correct the fuel supply amount so that the air-fuel ratio is kept at 14.7, to thereby compensate for differences (due to the deterioration) of the characteristics. As a result, the $O_2$ feedback correction coefficient shifts as shown in FIG. 9 (after time $T_{41}$). Thus, a judgment can be made of the deterioration degree of the components relating to the fuel supply system based on whether the shift exceeds a predetermined range ($-I_{th}$ to $+I_{th}$ in FIG. 9).

As was described above in connection with FIG. 6, in the conventional operation of checking malfunction of the purge air control system, the purge air passageway is sealed from time $T_0$ to $T_1$ to force purge air of the fuel tank 1 to be accumulated in the canister 3, and then the accumulated purge air is suddenly supplied to the intake pipe 20 of the engine 6.

In many cases, the forcibly accumulated purge air has a small air-fuel ratio (rich). If such purge air is suddenly introduced into the engine 6, the engine combustion will temporarily be rendered in an overrich state. Depending on the operation state of the engine 6, this may cause an ignition failure. If the ignition failure checking operation of FIG. 7 is effected in this state, the ignition failure due to the overrich combustion will be detected, which results in a misjudgment that there exists a failure in ignition components.

Similarly, a problem will occur if the operation of checking an $O_2$ sensor failure (see FIG. 8) is effected while the forcibly accumulated purge air is introduced into the engine 6 (time $T_1$ to $T_2$ in FIG. 6) in checking malfunction of the purge air control system. In this case, the actual air-fuel mixture will not become lean though the amount of fuel supplied to the engine 6 is reduced from time $T_{20}$ to $T_{21}$ (see FIG. 8) to make the air-fuel mixture lean. Since the $O_2$ sensor 9 does not produces a lean output signal, there will occur a misjudgment that the $O_2$ sensor 9 has failed.

A problem also occurs if the operation of checking malfunction of the fuel supply system (see FIG. 9) is effected while the forcibly accumulated purge air is introduced into the engine 6 (time $T_1$ to $T_2$ in FIG. 6) in checking malfunction of the purge air control system. In this case, the air-fuel mixture temporarily becomes overrich even though the components of the fuel supply system are normal and the correction coefficient of the $O_2$ feedback control is close to 1.0. To compensate for this, the correction coefficient is shifted to the lean side as shown in FIG. 9. If the correction coefficient goes beyond the worst level ($-I_{th}$), there will occur a misjudgment that the fuel supply system is malfunctioning.

In summary, the above-described misjudgments of the ignition failure, $O_2$ sensor failure and malfunction of the fuel supply system are caused by the air-fuel mixture made temporarily overrich due to the sudden introduction of the purge air filling the canister 3 into the engine during the operation of checking malfunction of the purge air control system.

SUMMARY OF THE INVENTION

An object of the present invention is to provide a system in which even if purge air filling a canister during an operation of checking malfunction of a purge air control system is suddenly introduced into an engine to temporarily make an air-fuel mixture overrich, it does not influence operations of checking a failure/malfunction of other exhaust gas control components/systems.

According to the invention, a self-diagnosing system for exhaust gas control components and systems for an engine, comprises:

purge air processing means for having purge air absorbed by an absorbent, and supplying purge air released from the absorbent to the engine through a purge air passageway by operating a control valve;

means for checking for a malfunction of the purge air processing means based on a variation of a fuel tank inner pressure or an air-fuel ratio of the engine in response to forced introduction of the purge air into the engine by the purge air processing means; and means for prohibiting operations of checking for a failure or malfunction of exhaust gas control components and systems other than the purge air processing means while the malfunction checking means is checking malfunction of the purge air processing means.

According to the invention, since checks of a failure/malfunction of exhaust gas control components/systems are performed in an intensive manner, it is possible to recognize when each checking operation is performed. Therefore, the operations of checking a failure/malfunction of the ignition system, $O_2$ sensor and fuel supply system are prohibited during the operation of checking malfunction of the purge air control system, to avoid such a case that a temporarily overrich air-fuel mixture causes a misjudgment in checking a failure/malfunction of the above component and systems. This will contribute to improvement of the reliability of the exhaust gas control components/systems.

DESCRIPTION OF THE PREFERRED EMBODIMENTS

Embodiment 1

Figure 1:
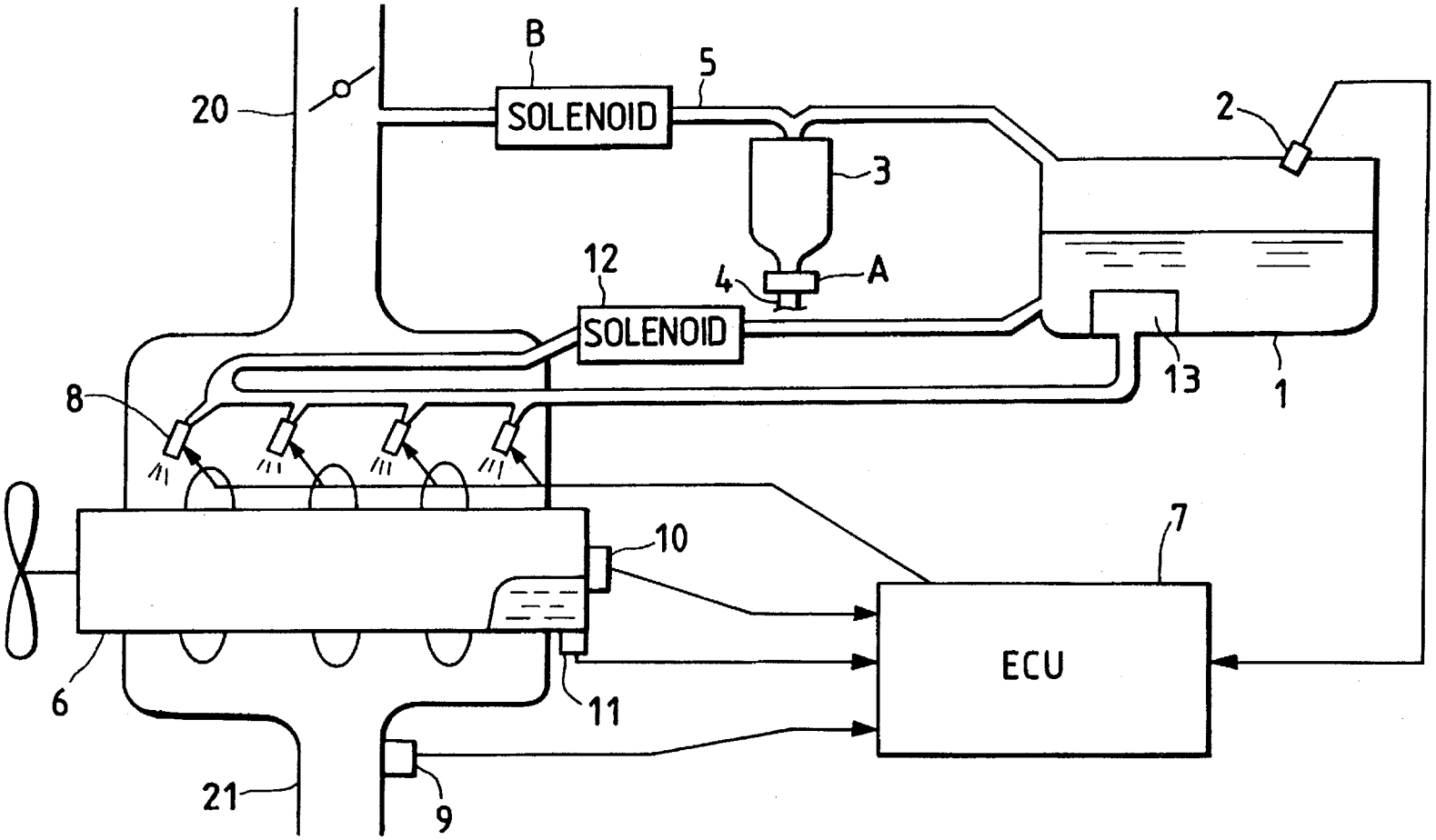
FIG. 1 shows the entire configuration of a system relating to purge air control.

A first embodiment of the present invention will be described with reference to FIGS. 1 and 2. This embodiment is characterized in that during a mode of checking malfunction of a purge air control system, failure/malfunction checks on other exhaust gas control components/systems, such an ignition system, an $O_2$ sensor and a fuel supply system, are prohibited.

First, the entire system relating to the exhaust gas control will be described with reference to FIG. 1. In FIG. 1, a pressure sensor 2 detects pressure in a fuel tank 1. A canister 3 allows purge air of a fuel (gasoline) coming from the fuel tank 1 to be absorbed by activated carbon provide in the canister 3. A solenoid A serves to open/close an air passageway 4 between the canister 3 and the exterior (atmosphere). A solenoid B is disposed between the canister 3 and an engine intake pipe 20, and serves to supply purge air (from the canister 3) to an engine 6. The engine 6 of a general automobile is controlled by an engine control computer unit (ECU) 7 in an intensive manner.

An $O_2$ sensor 9 is attached to an engine exhaust pipe 21, and detects the air-fuel ratio (a weight ratio of an intake air amount to a fuel amount; a ratio of 14.7 provides most effective cleaning of exhaust gas). Based on the detected information, the ECU 7 supplies a control signal to injectors 8 attached to respective cylinders of an intake manifold of the engine 6, to supply fuel to the engine 6.

A crank shaft sensor 10 is attached to a crank shaft of the engine 6, and produces a signal for every predetermined crank shaft angle. A fuel pump 13 is provided in the fuel tank 1 to supply fuel to the engine 6. A fuel pressure regulator 12 keeps at a predetermined value the pressure of fuel supplied to the injectors 8.

Next, a processing procedure of the first embodiment will be described with reference to a flowchart of FIG. 2.

Figure 6:
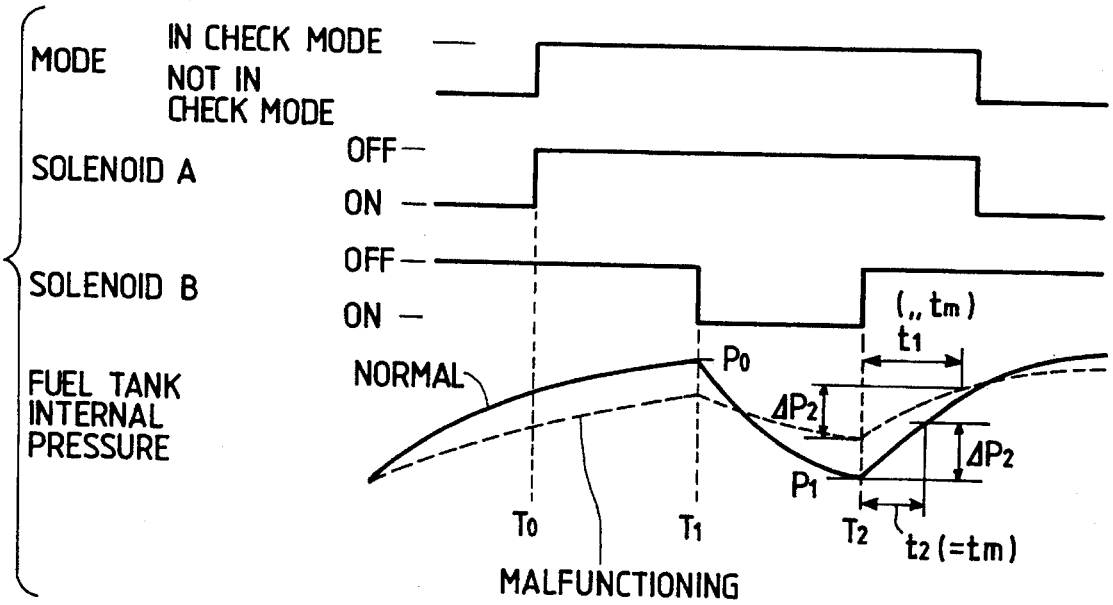
Figure 7:
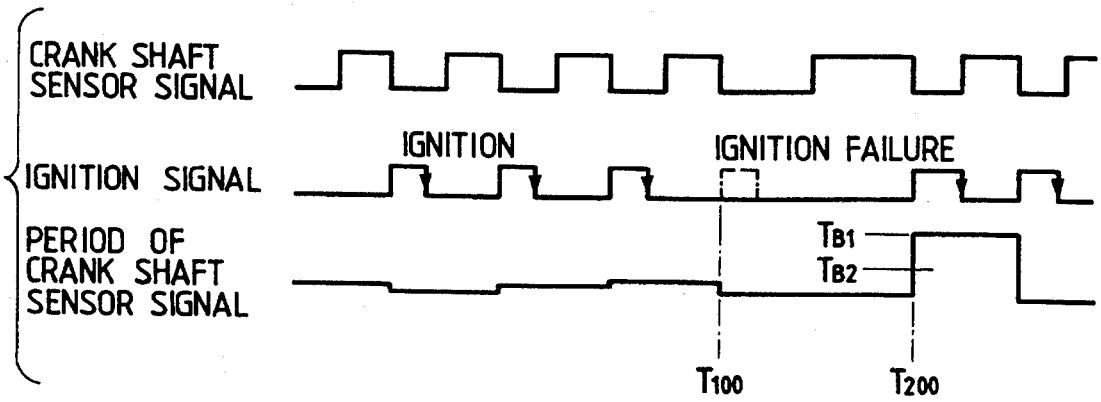
FIG. 7 PRIOR ART
FIG. 7 shows a conventional operation of checking an ignition failure.
Figure 8:
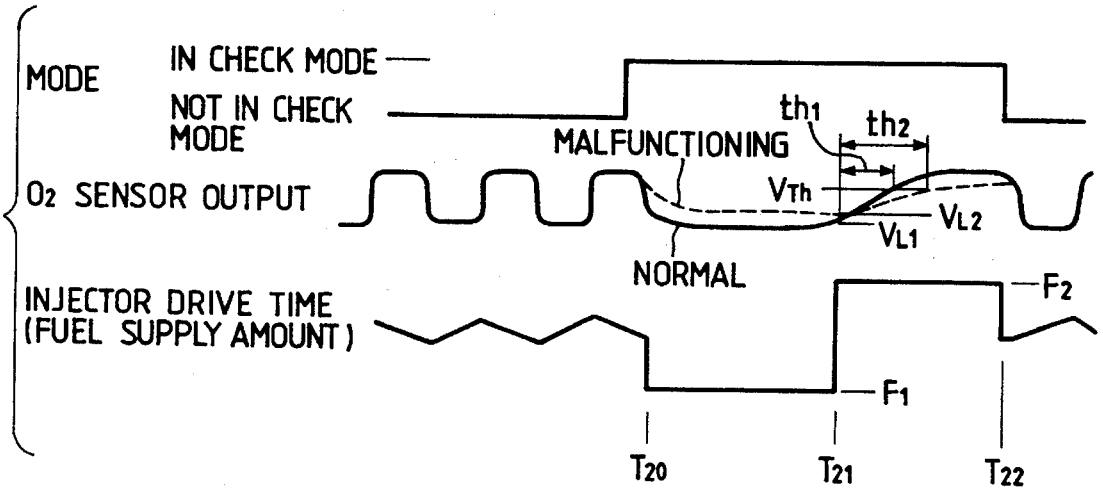
FIG. 8 PRIOR ART
FIG. 8 shows a conventional operation of checking an $O_2$ sensor failure.
Figure 9:
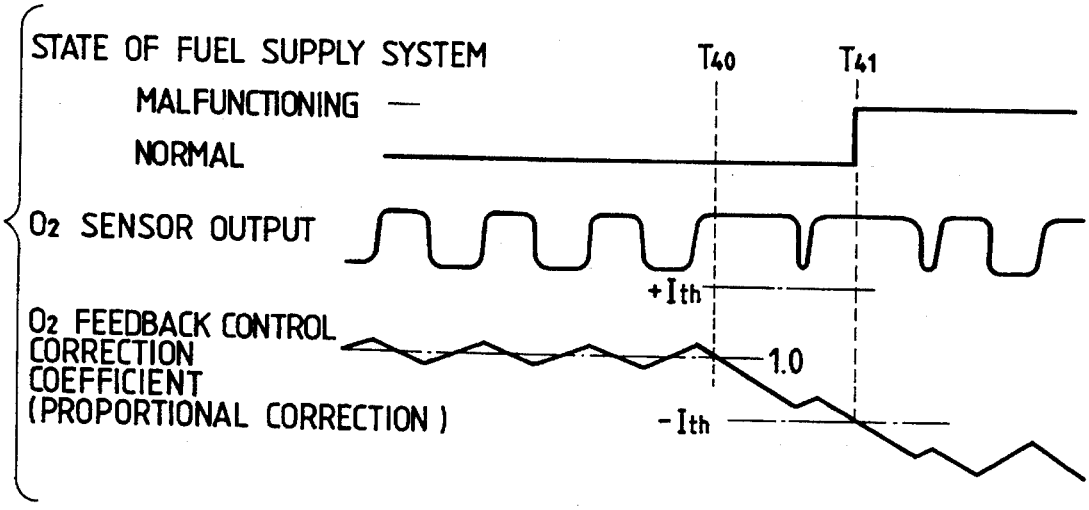
FIG. 9 PRIOR ART
FIG. 9 shows a conventional operation of checking malfunction of a fuel supply system.

First, it is judged whether the purge air control system is in a malfunction check mode (step 201). If the judgment is affirmative, the malfunction check processing on the purge air control system is performed according to the procedure described above in connection with FIG. 6 (step $2O_2$). With reference to FIG. 6, the solenoids A and B are turned off at time $T_0$ to close the air passageway 4 of the canister 3 and the engine-side passageway 5 to thereby seal the purge air passageway. After this state has been kept until time $T_1$, the solenoid B is turned on, so that the purge air filling the canister 3 is discharged to the engine intake pipe 20 until time $T_2$. A judgment is made of malfunction of the purge air control system by monitoring and checking the fuel tank inner pressure during the above series of processing (step 206). If the malfunction is detected, processing prepared for the occurrence of malfunction is performed (step 207). If the purge air control system is normal, it is left as it is.

On the other hand, if the purge air control system is not in the malfunction check mode (step 201), failure/malfunction checks on other exhaust gas control components/systems, such as an ignition system (step 203), an $O_2$ sensor (step 204) and a fuel supply system (step 205), are performed. If an ignition failure, an $O_2$ sensor failure or malfunction of the fuel supply system is detected, corresponding processing is performed as shown in FIG. 2.

Figure 2:
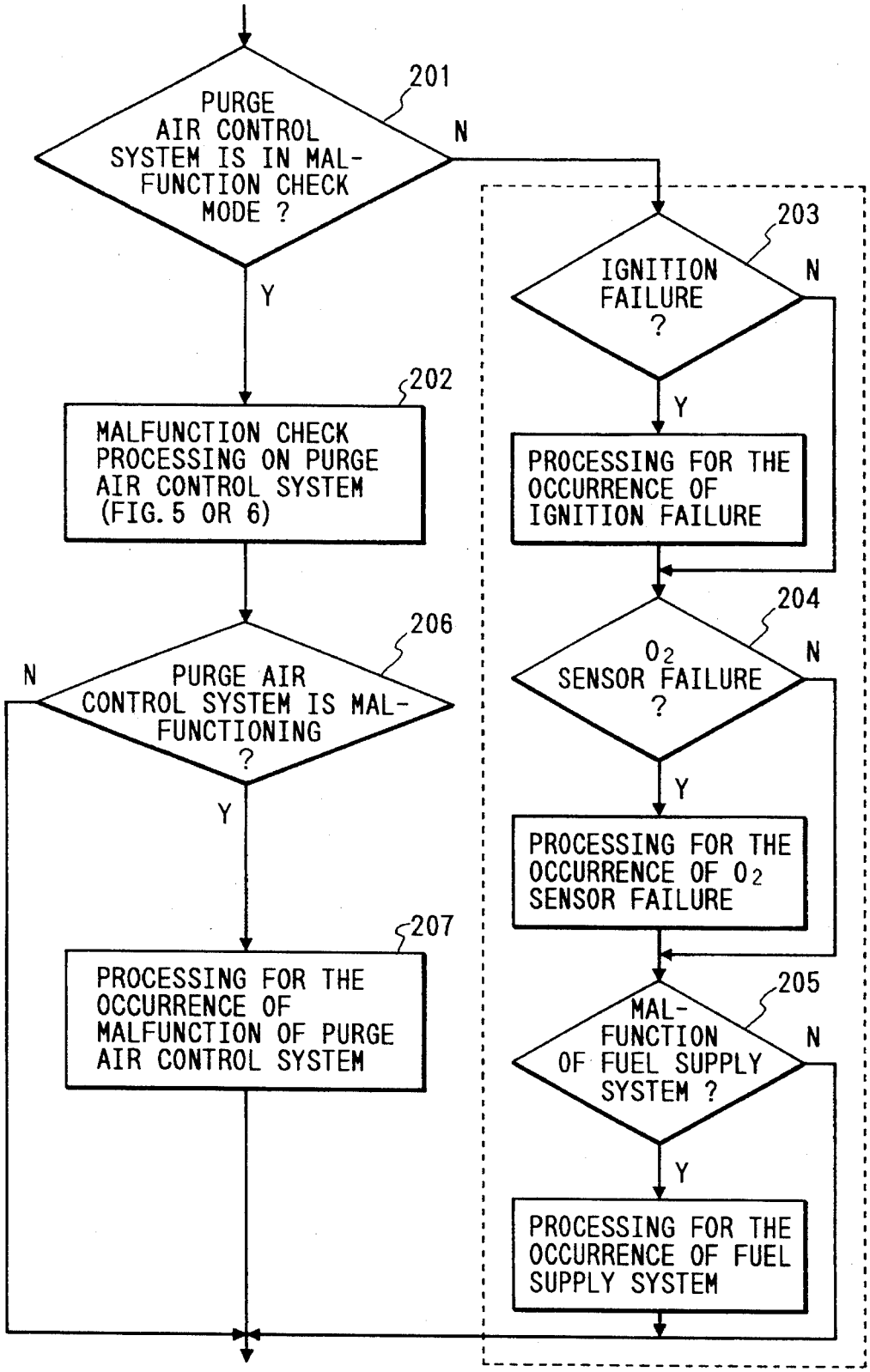
FIG. 2 is a flowchart showing a control procedure according to a first embodiment of the present invention.

It is noted that the order of the processing 203 to the processing 205 is not limited to that of FIG. 2. Further, they may be performed in a parallel manner.

According to the first embodiment, the failure/malfunction checks on other exhaust gas control components/systems, such as the ignition system, $O_2$ sensor and fuel supply system, are not effected during the malfunction check mode of the purge air control system. Therefore, the temporarily overrich air-fuel mixture due to the forced introduction of purge air into the engine 6 does not influence the operation of checking failure/malfunction of the exhaust gas control components/systems, to improve the reliability of the respective operations.

Embodiment 2

Figure 3:
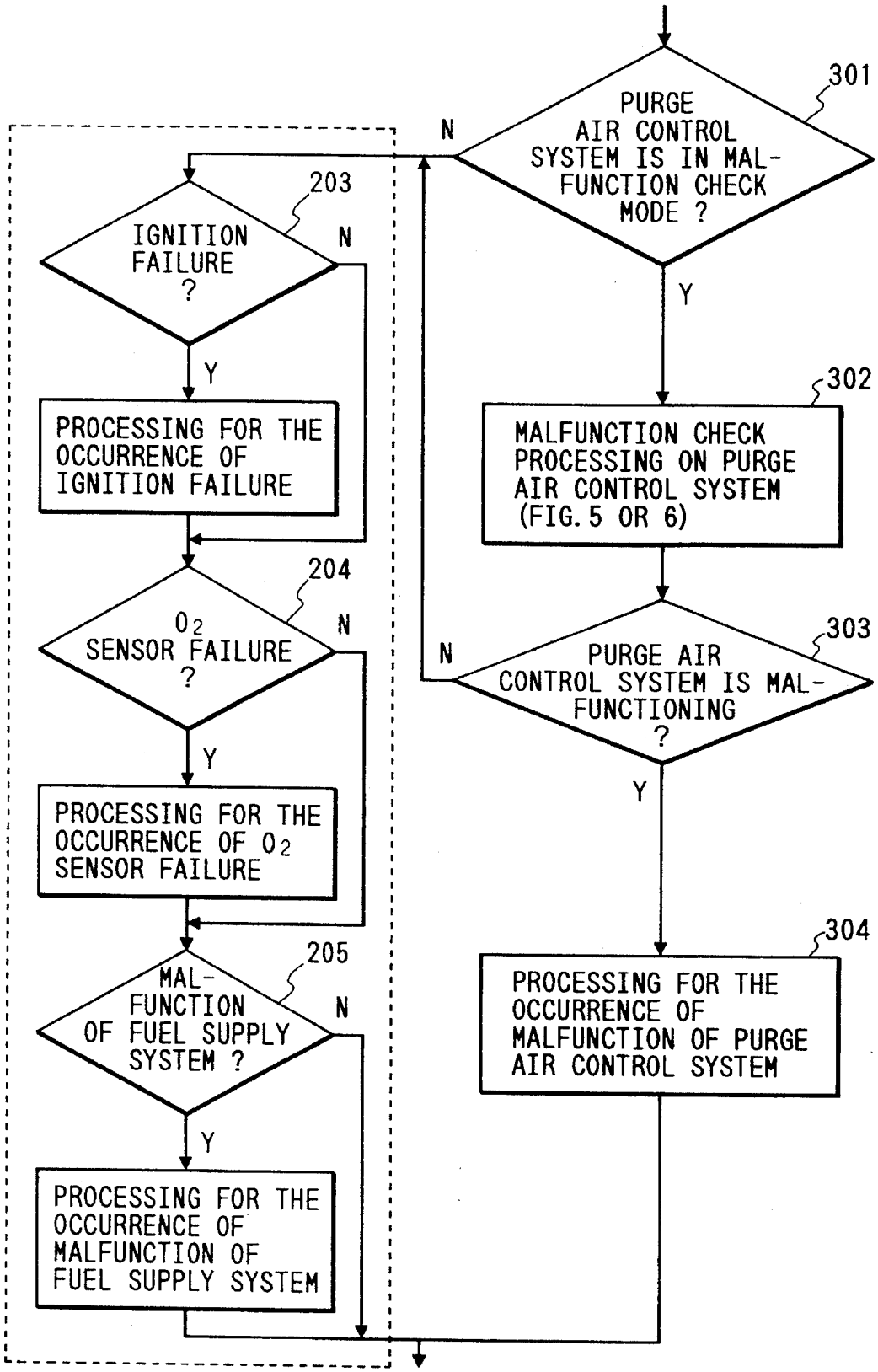
FIG. 3 is a flowchart showing a control procedure according to a second embodiment of the invention.

A processing procedure of a second embodiment will be described with reference to a flowchart of FIG. 3.

If it is judged in step 301 that the purge air control system is in the malfunction check mode, the malfunction check processing on the purge air control system is performed according to the procedure described above in connection with FIG. 6 (step 3O2). And it is judged whether the purge air control system is malfunctioning (step 303). If the judgment is negative, the failure/malfunction checks on other exhaust gas control components/systems, such as the ignition system (step 203), $O_2$ sensor (step 204) and fuel supply system (step 205), are performed.

As described above, the second embodiment is different from the first embodiment in that the failure/malfunction checks on other exhaust gas control components/systems are effected also when the purge air control system is judged to be normal. Therefore, the control of the second embodiment is more efficient than the first embodiment.

Embodiment 3

Figure 4:
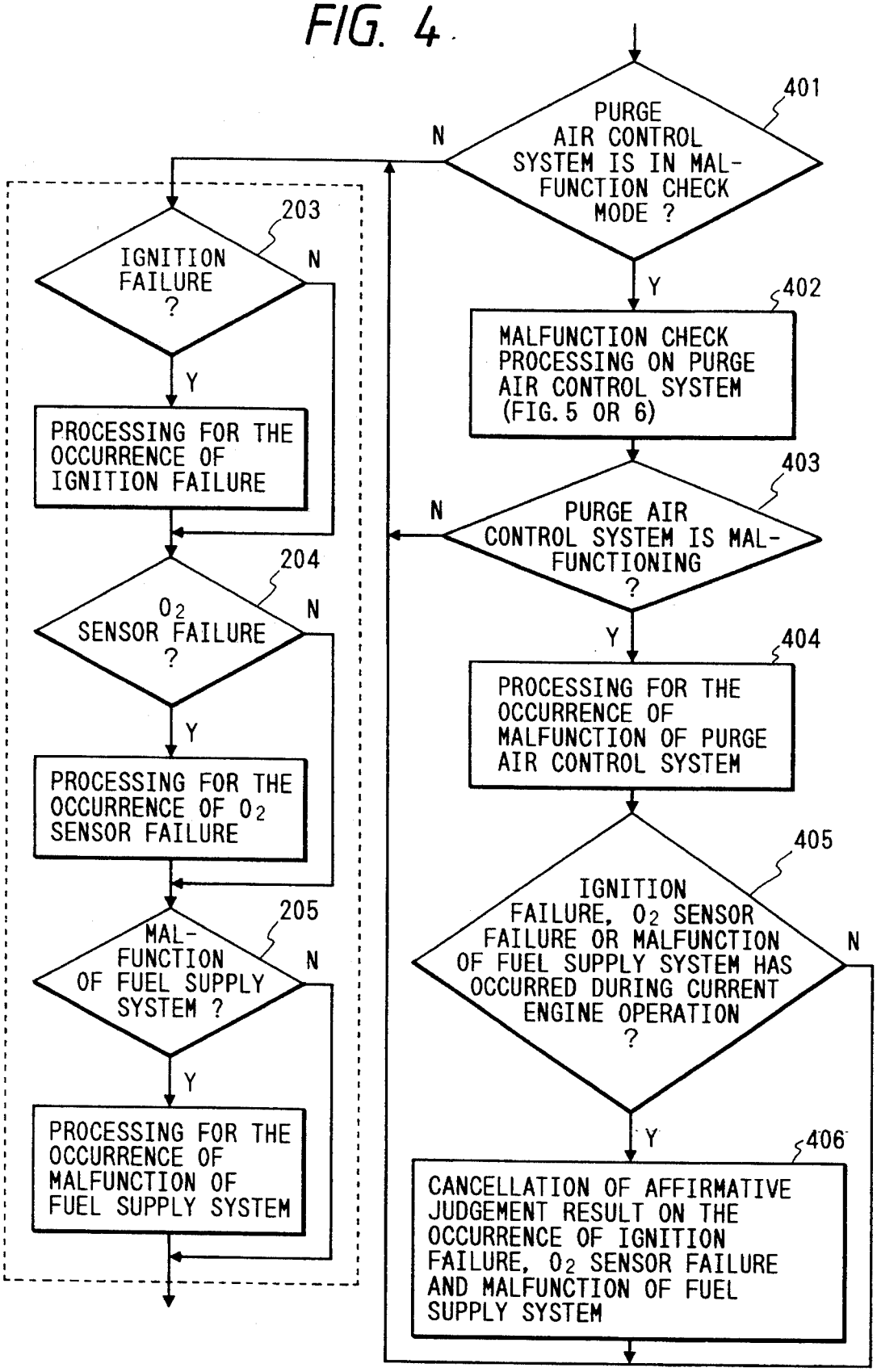
FIG. 4 is a flowchart showing a control procedure according to a third embodiment of the invention.

A processing procedure of a third embodiment will be described with reference to a flowchart of FIG. 4.

First, as in the case of the second embodiment, it is judged whether the purge air control system is in the malfunction check mode (step 401). If the judgment is affirmative, the malfunction check processing on the purge air control system is performed according to the procedure described above in connection with FIG. 6 (step 4O2).

If the purge air control system is judged to be malfunctioning (step 403), the processing prepared for the occurrence of malfunction of the purge air control system is performed (step 404). Then, if it has already been judged that a failure/malfunction has occurred in other exhaust gas control components/systems (ignition system, $O_2$ sensor and fuel supply system) during the current engine operation (step 405), the affirmative judgment result on the occurrence of a failure/malfunction is canceled. Then, the failure/malfunction checks of an ignition failure (step 203), an $O_2$ sensor failure (step 204) and malfunction of the fuel supply system (step 205) are performed.

As described above, according to the third embodiment, if the purge air control system is judged to be malfunctioning, the processing prepared for the occurrence of malfunction is performed, and then the affirmative judgment result on the occurrence of an ignition failure, an $O_2$ sensor failure and malfunction of the fuel supply system is canceled. Therefore, the accuracy of the failure/malfunction judgment result is increased and the failure/malfunction checking procedure becomes efficient.

While the first to third embodiments are directed to the case where malfunction of the purge air control system is checked based on the variation of the fuel tank inner pressure, the invention can similarly be applied to the case where the purge air control system is checked based on how the air-fuel ratio of the engine 6 varies upon forced introduction of purge air.

Figure 5:
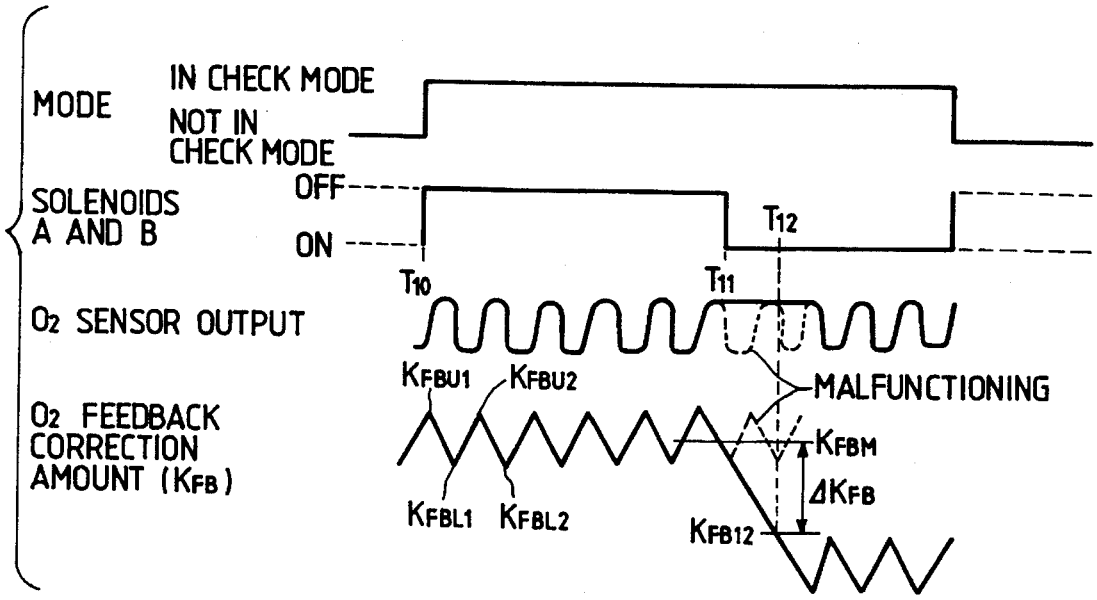
FIGS. 5 and 6 show operations of checking malfunction of the purge air control system.

With reference to FIG. 5, an operation of checking malfunction of the purge air control system based on the variation of the air-fuel ratio (A/F) of the engine 6 will be described.

The ECU 7 judges of the operation state of the engine 6 by recognizing the rotation speed and the idling state of the engine 6 based on the signals sent from the crank shaft sensor 10 and the water temperature sensor 11, respectively. If the engine operation is in such a state that the idling has completed and the engine 6 is ready for the $O_2$ feedback control, the ECU 7 establishes the mode of checking malfunction of the purge air control system at time $T_{10}$, and closes the air passageway 4 of the canister 3 and the engine-side passageway 5 by turning off the solenoids A and B to thereby seal the purge air passageway. As a result, with no places to go, purge air fills the space of the fuel tank 1 and the canister 3. After this sealed state is kept for a predetermined period, i.e., until time $T_{11}$, the solenoid B is turned on to suddenly discharge the purge air filling the canister 3 to the engine intake pipe 20.

On the other hand, the $O_2$ feedback control continues during this malfunction check mode. That is, as shown in Fig. 5, an $O_2$ feedback correction amount $K_{FB}$ is varied so as to reverse the output voltage of the $O_2$ sensor 9, i.e., to maintain the air-fuel ratio (A/F) of 14.7 . Based on the correction amount $K_{FB}$ , the ECU 7 corrects the width of the instruction signal to the injector 8 to thereby control the amount of fuel to be supplied to the engine 6.

A mean $O_2$ feedback correction amount $K_{FBM}$ over the purge air cut period of $T_{10}$ to $T_{11}$ is calculated according to Equation (1):

$$K_{FBM}=\frac{K_{FBU1}+K_{FBL1}}{2}+\frac{K_{FBU2}+K_{FBL2}}{2}+\ldots \quad (1)$$

where ($K_{FBU1}$ , $KF_{FBU2}$, . . . ) are values of $K_{FB}$ at times when the output voltage of the $O_2$ sensor 9 is inverted from lean to rich in the purge air cut period and ($K_{FBL1}$, $K_{FBL2}$, . . . ) are values of $K_{FB}$ at times when it is inverted from rich to lean.

After time $T_{11}$ , purge air is supplied to the engine 6 for a predetermined period. Then, $K_{FB}$ ($K_{FB12}$ ) is measured at time $T_{12}$, and its deviation AKFs from above-obtained $\Delta K_{FBM}$ is calculated as follows.

$$\Delta K_{FB}=K_{FBM}-K_{FB12} \quad (2)$$

While the purge air control system operates normally, the purge air that has been accumulated in the canister 3 from $T_{10}$ to $T_{11}$ is supplied to the engine 6 (as a rich air-fuel mixture) after $T_{11}$. Resulting exhaust gas is detected by the $O_2$ sensor 9, and control is made by the $O_2$ feedback so as to maintain A/F of 14.7. As a result, the $O_2$ feedback correction amount $K_{FB}$ is reduced to change the air-fuel mixture to the lean side, so that $\Delta K_{FB}$ according to Eq. (2) takes a large value.

If, for instance, the purge air passageway has a damaged portion anywhere from the fuel tank 1 to the engine intake pipe 20 or there is a purge air leak due to improper functioning of the solenoid A or B, the canister 3 is not filled with purge air during the period of $T_{10}$ to $T_{11}$ . Therefore, even after the turning on of the solenoid B at $T_{11}$ , the air-fuel mixture supplied to the engine 6 does not become rich and, as a result, the correction to the lean side by a change of the $O_2$ feedback coefficient is not effected. Thus, the deviation $\Delta K_{FB}$ takes a smaller value than in the case where the purge air control system operates normally.

In the above manner, it is possible to check malfunction of the purge air control system by monitoring the deviation $\Delta K_{FB}$ of the $O_2$ feedback correction amount.

According to the first to third embodiments, the checks of an ignition failure, an $O_2$ sensor failure and malfunction of the fuel supply system are not performed during the operation of checking malfunction of the purge air control system when an overrich air-fuel mixture may cause an erroneous judgment in those checks. Therefore, the reliability of each failure/malfunction check can be improved.

When a failure/malfunction judgment result may be wrong at a certain probability, it is a general procedure to conduct a plurality of failure/malfunction checks to obtain a final judgment. However, in the case of, for instance, the check of an $O_2$ sensor failure, a temporary suspension of the $O_2$ feedback and a shift of the air-fuel ratio for the failure check will deteriorate exhaust gas quality during the suspension. That is, the failure check, which is originally intended to find a cause of deteriorating exhaust gas, may deteriorate it instead.

According to the first to third embodiments, the number of execution times of failure/malfunction check processing can be reduced by improved reliability of each failure/malfunction check, and factors of causing an exhaust gas deterioration during the failure/malfunction checks can be reduced as much as possible.

As described above, according to the invention, to prevent such a case that a variation of the air-fuel ratio of the engine caused by the forced cut and introduction of purge air during the operation of checking malfunction of the purge air control system influences the failure/malfunction checks on other exhaust gas control components/systems, those checks, such as the check of malfunction of the ignition system (an ignition failure), the $O_2$ failure check and the check of malfunction of the fuel supply system are prohibited during the operation of checking malfunction of the purge air control system. Therefore, the reliability of those failure/malfunction checks can be improved.

The failure/malfunction checks on other exhaust gas control components/systems may also be effected if the purge air control system is judged to be normal. If the purge air control system is judged to be malfunctioning, it is conceivable that purge air has caused an A/F variation in the process resulting in the malfunction. Therefore, in such a case, if a failure/malfunction has already been found in another exhaust gas control component/system during the current engine operation, the affirmative judgment result on the occurrence of a failure/malfunction is canceled and the checks are again performed while the purge air control system is normal. Therefore, the efficiency of checking a failure/malfunction of other exhaust gas control components/systems can be improved.

In summary, according to the invention, the exhaust gas control components/systems are subjected to failure/malfunction checks only when the engine operation state allows those checks to be performed in a positive manner. The invention improves the reliability of the failure/malfunction checks and allows trouble shooting in a market to be smoothly performed.

What is claimed is:

1. A self-diagnosing system for exhaust gas control components and systems for an engine, comprising:

purge air processing means for having purge air absorbed by an absorbent, and supplying purge air released from the absorbent to the engine through a purge air passageway by operating a control valve;

means for checking for a malfunction of the purge air processing means based on a variation of a fuel tank inner pressure or an air-fuel ratio of the engine in response to forced introduction of the purge air into the engine by the purge air processing means;

means for prohibiting operations of checking for a failure or malfunction of exhaust gas control components and systems other than the purge air processing means while the malfunction checking means is checking for a malfunction of the purge air processing means; and means for canceling an affirmative result of a judgment, already made during a current engine operation, of the failure or malfunction of the exhaust gas control components and systems other than the purge air processing means if the malfunction checking means judges that the purge air processing means is malfunctioning.

2. The self-diagnosing system of claim 1, wherein the exhaust gas control components and systems include at least one of an ignition system, an $O_2$ sensor and a fuel supply system.

3. The self-diagnosing system of claim 1, further comprising means for allowing the operations of checking for a failure or malfunction of the exhaust gas control components and systems other than the purge air processing means if the malfunction checking means judges that the purge air processing means is normal.

4. A self-diagnosing system for exhaust gas control components and systems for an engine, comprising:

purge air processing means for having purge air absorbed by an absorbent, and supplying purge air released from the absorbent to the engine through a purge air passageway by operating a control valve;

means for checking for a malfunction of the purge air processing means based on a variation of a fuel tank inner pressure or an air-fuel ratio of the engine in response to forced introduction of the purge air into the engine by the purge air processing means;

means for suspending operations of checking for a failure or malfunction of exhaust gas control components and systems other than the purge air processing means while the malfunction checking means is checking for a malfunction of the purge air processing means, and allowing said operations to resume after said malfunction checking means completes checking for a malfunction of the purge air processing means; and means for canceling an affirmative result of a judgment, already made during a current engine operation, of the failure or malfunction of the exhaust gas control components and systems other than the purge air processing means if the malfunction checking means judges that the purge air processing means is malfunctioning.

* * * * *